US009415260B2

(12) United States Patent
Islas

(10) Patent No.: US 9,415,260 B2
(45) Date of Patent: Aug. 16, 2016

(54) PLANTAR EXERCISE DEVICE

(71) Applicant: Edward J. Islas, Liverpool, NY (US)

(72) Inventor: Edward J. Islas, Liverpool, NY (US)

( * ) Notice: Subject to any disclaimer, the term of this patent is extended or adjusted under 35 U.S.C. 154(b) by 0 days.

(21) Appl. No.: 14/593,501

(22) Filed: Jan. 9, 2015

(65) Prior Publication Data

US 2016/0199690 A1 Jul. 14, 2016

(51) Int. Cl.
*A63B 23/08* (2006.01)
*A63B 23/10* (2006.01)
*A63B 26/00* (2006.01)

(52) U.S. Cl.
CPC ..... *A63B 23/10* (2013.01)

(58) Field of Classification Search
CPC .. A63B 21/00; A63B 21/00047; A63B 21/06; A63B 21/068; A63B 21/4029; A63B 23/00; A63B 23/04; A63B 23/10; A63B 23/035; A63B 23/08; A63B 23/085; A63B 23/0458; A63B 2023/006
USPC ..... 482/23, 51, 52, 79, 80, 92, 93, 131, 482/139, 141, 142, 148, 907, 910
See application file for complete search history.

(56) References Cited

U.S. PATENT DOCUMENTS 3,284,819 A * 11/1966 Nissen ..... A47C 27/001 297/378.1
3,747,233 A * 7/1973 Berryman ..... A63B 23/0464 434/255
4,105,201 A 8/1978 L'Ecuyer et al.
4,253,661 A * 3/1981 Russell ..... A63B 21/00047 482/51
4,603,851 A 8/1986 Russell
5,066,001 A * 11/1991 Wilkinson ..... A63B 6/00 482/52
5,087,036 A * 2/1992 Cooper ..... A63B 23/085 482/79
5,184,987 A * 2/1993 Wilkinson ..... A63B 23/0458 297/423.45
5,284,465 A 2/1994 Homan, Jr.
5,322,490 A * 6/1994 Van Der Hoeven ..... A63B 69/0022 472/90
5,328,427 A * 7/1994 Sleamaker ..... A63B 21/4045 482/110
5,643,164 A 7/1997 Teff
5,669,089 A * 9/1997 Dees ..... B25H 5/00 5/417
5,743,831 A 4/1998 Jakich
5,950,260 A * 9/1999 Dees ..... A47C 9/02 5/417
6,238,320 B1 * 5/2001 Flanagan ..... A63B 3/00 482/130
6,244,992 B1 6/2001 James
6,453,485 B2 * 9/2002 Bullock ..... A47K 3/002 4/580
7,011,612 B2 3/2006 Repking
7,036,162 B1 * 5/2006 Gatten ..... A47C 21/04 5/420

(Continued)

*Primary Examiner* — Steve R Crow
*Assistant Examiner* — Garrett Atkinson
(74) *Attorney, Agent, or Firm* — Bernhard P Molldrem, Jr.

(57) ABSTRACT

A plantar exercise device for therapeutic foot exercises is formed of a generally planar base board and a beam or block member firmly secured upon the base board and positioned transversely across the base board. The beam is positioned closer to one end of the base board than the other, so that the different stretch heights are presented on the two sides. Additional blocks may be present to provide additional stretch height. A non slip coating may be applied at least onto the upper surfaces of the beam and base board.

12 Claims, 3 Drawing Sheets

(56) References Cited

U.S. PATENT DOCUMENTS

| | | | | |
|---|---|---|---|---|
| 7,635,321 | B2 | 12/2009 | Hill et al. | |
| 7,857,733 | B2 | 12/2010 | Tsakiris | |
| 7,988,602 | B1 | 8/2011 | Janzen | |
| 8,360,940 | B2 | 1/2013 | Kole et al. | |
| 8,701,654 | B2 * | 4/2014 | Newburger | A63B 21/065 482/130 |
| 9,114,278 | B1 * | 8/2015 | Sigel | A63B 22/0694 |
| 2001/0034907 | A1 * | 11/2001 | Bullock | A47K 3/002 4/580 |
| 2003/0104910 | A1 * | 6/2003 | McCoy | A47G 27/0418 482/142 |
| 2003/0199372 | A1 * | 10/2003 | Robinson | A63B 21/068 482/140 |
| 2005/0192158 | A1 * | 9/2005 | Edwards | A63B 21/4037 482/23 |
| 2006/0243522 | A1 * | 11/2006 | Hart | A61H 3/00 182/63.1 |
| 2009/0270236 | A1 * | 10/2009 | Berc | A47C 7/36 482/142 |
| 2012/0040810 | A1 | 2/2012 | Astilla | |
| 2013/0017372 | A1 * | 1/2013 | Mechling | A63B 6/00 428/192 |
| 2013/0090216 | A1 * | 4/2013 | Jackson | A63B 21/018 482/52 |
| 2014/0100086 | A1 | 4/2014 | Pagliaro | |
| 2014/0274589 | A1 | 9/2014 | Harkins | |

* cited by examiner

PLANTAR EXERCISE DEVICE

BACKGROUND OF THE INVENTION

This invention is directed to the field of exercise equipment, namely, exercise aids for use in strength building exercises and therapeutic exercises for the foot and lower leg, and more particularly concerned with an exercise aid for exercise therapy for relief of plantar fasciitis.

The present invention is more specifically directed to a foot plate or foot bar device that allows a person to perform stretching exercises of the foot and to perform toe-lift exercises, and which provides results superior to current techniques for stretching plantar tissues and tendons of the foot.

The device can be used for men, women, or children, but for convenience where the pronouns "he", "him", and "his" may be employed, they may be taken to apply to persons of either gender. The device can be used for either the right or left foot, or both.

Plantar fasciitis is a condition of the inner tissues of the sole of the foot that can involve an irritation of the fascia or boundary tissues in the tendons, ligaments, muscles and cartilage that make up the plantar. This condition can be quite painful. Special stretching exercises are sometimes prescribed or recommended, but are difficult to carry out on equipment that is currently available.

OBJECTS AND SUMMARY OF THE INVENTION

Accordingly, the exercise aid of this invention is intended and designed to assist persons who suffer from plantar fasciitis, although the device may also be used for other purposes such as stretches and toe lifts. This device permits the person to carry out all the exercises and stretches that may be prescribed or recommended by a physical therapist. The device is a stable, but portable device, that will not rotate or slide away when the person performs the prescribed exercises or stretches. The unit has an anti-slip surface coating or similar treatment, and its design reduces the foot-pounds-per-square-inch on the surface(s) of the device, and the floor or other surface on which the exercise aid is used. The underside may also have a non-slip treatment to reduce the sliding on the floor surface, preventing damage to the flooring. With this device, the subject can enjoy a complete range of motion for calves, toes, and foot muscles, and also allowing all the lower leg muscles and tendons to stretch.

According to one aspect of the present invention, plantar exercise device for a person to use for therapeutic foot exercises is formed of a flat base board and a block or beam supported on the base board. The flat base board has first and second ends spaced in a longitudinal direction from one another, with a center midway between the first and second ends. The top surface and an underside of the base board are spaced apart by a thickness of a nominal one inch, which in practice may be ¾ to ⅞ inch, or may be a full inch. The underside of the base board is adapted to rest upon a floor surface. The block member or beam rigidly supported upon the base board and extends across the base board transversely to the longitudinal direction. The block member has an upper planar surface that is spaced a predetermined height above the top surface of the base board, and the block member or is positioned between center of the base board and the second end of the base board. The base board, in one preferred embodiment, provides a first exercise position between the first end of the baseboard and the block member. The first exercise position has sufficient length such that the user places his foot with the heel on the top surface of the base board and his toes on the upper planar surface of the block member. The block also defines a second exercise position extending the said block member in the direction of the second end and of small enough length such that the user places his foot with the heel on said floor surface beyond said second end and his toes on the upper planar surface of the block member.

The plantar exercise favorably has a non-slip treatment applied onto the top surface of the base board and onto the upper planar surface of said block member.

The block member may comprise a plurality of thicknesses and can be configured so that such thicknesses can be added or removed to modify the height of the upper planar surface above the base board. This can be accomplished with dowels and sockets in the various thicknesses so that they can be added or removed easily.

Favorably, the said block member may be a solid block member of a nominal thickness of four inches, defining the predetermined height as a nominal four inches. In practice, this may be 3 inches, 3½ inches or 3¾ inches. Rather than being solid, in some embodiments, the block member can be a square tubular member having a solid top member defining the upper planar surface, and a hollow core. The core can be open or can be filled with a suitable plastic foam.

A handle cut-out is formed in said base board between said block member and one or the other or both of the first and second ends of the base board.

Additional block members can be affixed at one or both ends of the block member or beam so that the stretching exercises can be performed from the sides of the device. In that case each of the additional block members can extend a short way across the block member or beam from the respective end.

According to another aspect, the plantar exercise device is comprised of a planar base board and a transverse beam or block member.

The planar base board may be of a rectangular shape and may have a first end and a second end that are spaced apart by a nominal distance of twenty inches. Left and right sides of the base board are favorably separated by a transverse distance of a nominal twelve inches, and top and bottom surfaces are separated by a nominal distance of one inch. Uniform thickness of the base board is not critical, so long as the exercise aid can carry out its function.

The beam or block member is affixed onto the base board and extends transversely across the base board. The block member has an upper planar surface of height and width of a nominal four inches, and the block member is favorably spaced from the first end of the base board by a distance of a nominal twelve inches and spaced from the second end by a nominal five inches.

The plantar exercise device can be available in different sizes, depending on the foot size or shoe size of the person for whom it is intended.

A non-slip treatment can favorably be applied onto the top surface of the base board and onto the upper surface of the block member.

In some embodiments, the base board may be hinged at the center so that it can be folded in half for storage or transport.

The user can carry out the exercise on the one side of the block by stepping on the base board with his (or her) heel on the base board and his toes on the beam or block member. This creates a toe lift or stretch height of about 3½ inches, and the user can do several repetitions of a stretch exercise to stretch the foot sole and lower calf. The user may also carry out the exercise on the other side, with his heel on the floor, past the second end of the base board, and with his toes on the beam or block member. This creates a toe lift or stretch height of about 4½ inches, for a different amount of stretch for the foot sole and lower calf. The additional block members mentioned above create other stretch heights.

The above and many other objects, features, and advantages of the crossbow of this invention will become apparent from the following detailed description of selected preferred embodiments, to be considered in connection with the accompanying figures of drawing.

DETAILED DESCRIPTION OF A PREFERRED EMBODIMENT

Figure 1:
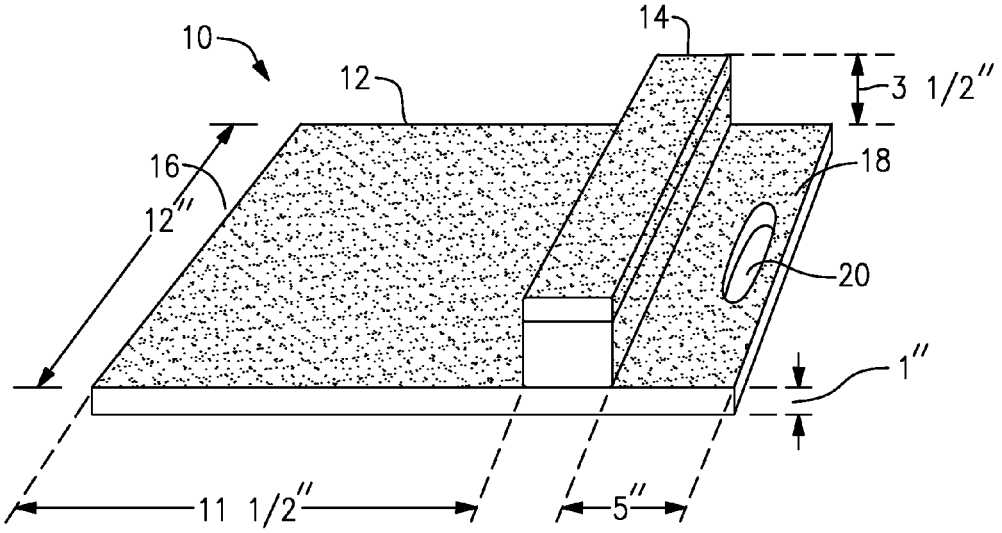
FIG. 1 is a perspective view of an exercise device embodying this invention.

The invention is explained first in terms of a possible preferred embodiment, here a plantar exercise aid 10, in its simplest form is formed of a base board 12 and a beam or block 14 that extends transversely across the base board 12 at a position that is beyond the mid point of the board, i.e., further from a first end 16 and closer to a second end 18 of the board 12. In this embodiment, the base board is formed of a durable rigid material, i.e., wood, aluminum, or plastic, rectangular in shape with a width of a nominal twelve inches, a length of a nominal twenty inches, and here with a uniform thickness of a nominal one-inch. The beam or block 14 is twelve inches long, with a height and width each of a nominal three and one-half inches. The beam is secured onto the upper surface of the base board, so that it is about eleven and one-half inches from the first end 16 and about four inches from the second end 18. The beam may be permanently affixed to the base board, or may be secured on pegs or dowels so that it can be removed (e.g., to replace with a beam of a different height). Here the beam is shown as being of two thicknesses stacked together, but the beam may be one piece, or may be formed of three or more pieces suitably stacked together. At one end or the other (or both) of the board an optional hand-hold hole or cutout 20 is formed, to facilitate picking up the exercise aid and carrying it.

The dimensions as disclosed just above are not critical to the invention. This embodiment is suitable for a male with average size feet. The exercise aid 10 can be made larger or smaller, in different sizes to suit different individuals.

At least the upper surfaces of the base board 12 and the beam or block 14 can preferably be given a non-slip treatment, e.g., a rubberized coating, so that the sole and heel of the user's shoe do not slip. The underside of the base board may be non-slip as well, so that the unit does not slide on the floor.

Figure 2:
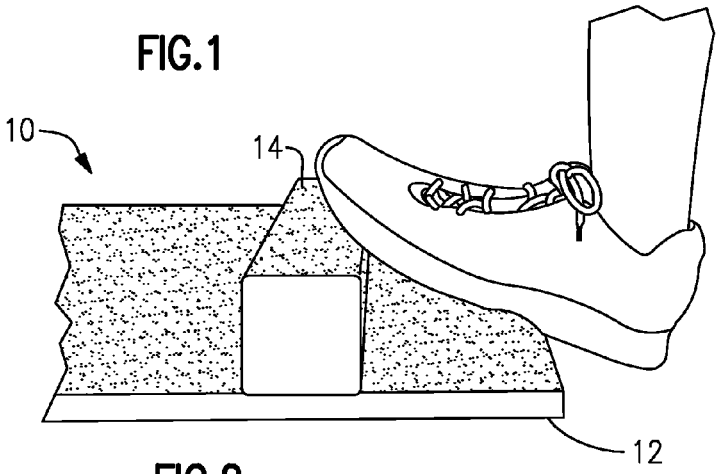
FIG. 2 is a side view demonstrating one mode of use of this embodiment.
Figure 3:
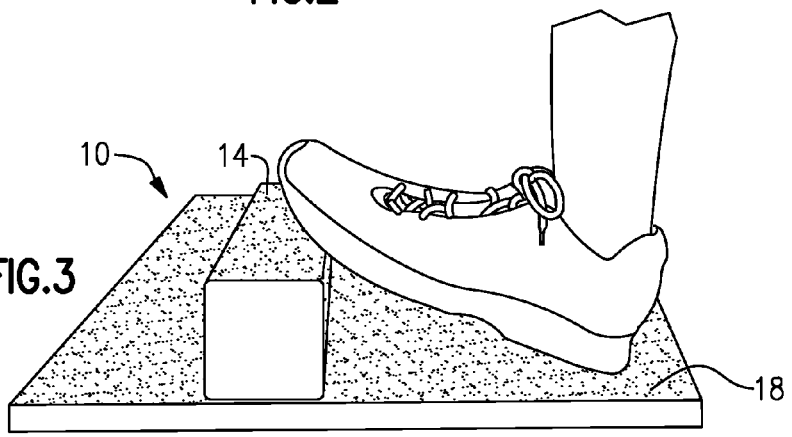
FIG. 3 is a side view demonstrating another mode of use of this embodiment.

FIGS. 2 and 3 show manners of using the exercise aid 10 in therapeutic foot stretching or toe lift exercises. As shown in FIG. 2 the user places his or her foot F on the exercise aid 10 with the toe of the shoe on the beam 14 and with the heel of the shoe on the floor just beyond the end 18 of the base board 12. The user can bend the knee and place weight on the toes to stretch the plantar tissues in his or her foot. In this case there is an elevation for the toe of about four and one-half inches. For slightly less stretch the user can stand with his or her foot F on the opposite side of the base board 12, as shown in FIG. 3, with the heel of the shoe on the top surface of the base board 12 between the beam 14 and the first end 16, and with the toes on the top surface of the beam 14. The puts the toes of the user about three-and-one half inches above the heel. The stretching and therapeutic exercises are then performed in the same fashion.

Figure 4:
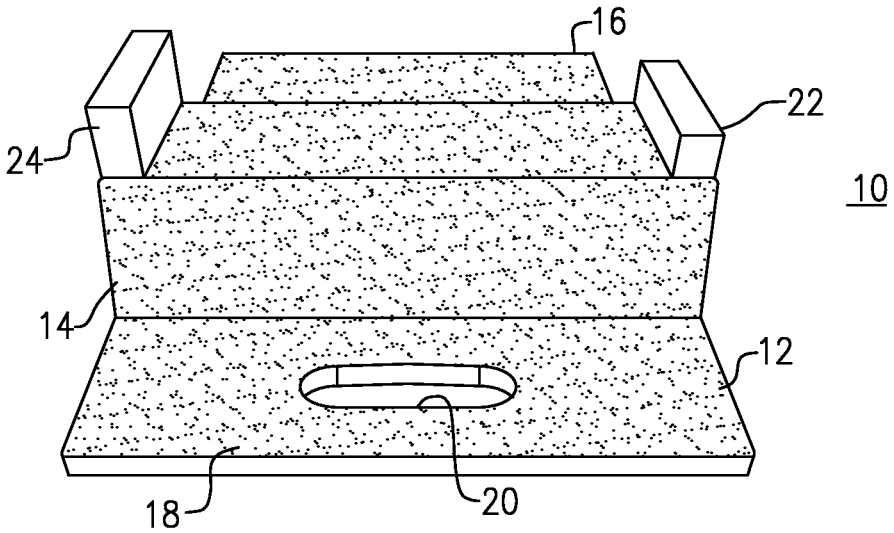
FIG. 4 is a perspective view of another embodiment.

As shown in FIG. 4, there may be additional blocks 22 and 24 affixed onto the top surface of the beam or block 14, here shown at the ends of the block that align with transverse edges of the base board. One block 22 has a height of three-quarters inch and the other block has a height of one-and-one-half inches. This creates additional surfaces for the user's foot to create additional options for stretching or toe lifts.

Figure 5:
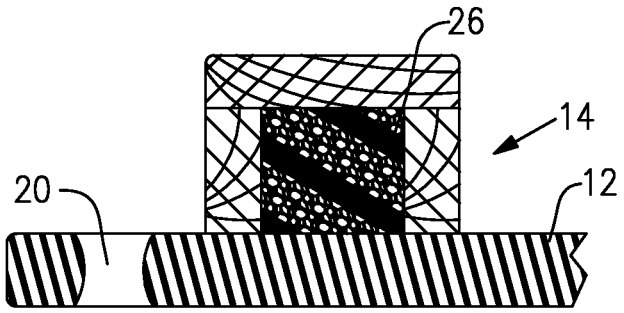
FIG. 5 is a cross-section showing the beam or block member of one embodiment.

The beam or block may be solid, or as illustrated in FIG. 5, the beam may be hollow or open in the interior to relieve some of the weight of the exercise aid. The hollow may optionally be filled with a plastic foam 26.

Figure 6:
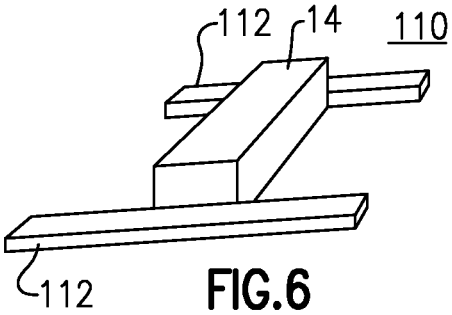
FIG. 6 is a perspective view of a further embodiment.

Another embodiment may be of the form as generally shown in FIG. 6, in the exercise aid 110 has the block or beam 14 resting directly on the floor, and rather than employing a solid base board as in the previously described embodiments, there are legs 112 on each end of the beam that each extend to both sides of the block 14 so that the block is held steady and does not rotate. This may be considered as having a "split" baseboard made up of the two legs 112.

Figure 7:
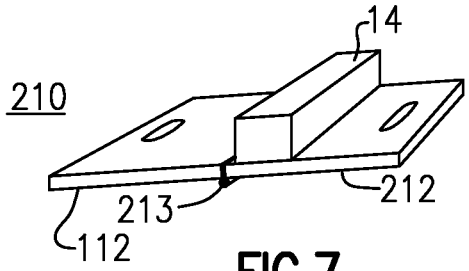
FIG. 7 and FIG. 8 are perspective views of yet another embodiment, in an open position and being folded into a storage and travel position, respectively.
Figure 8:
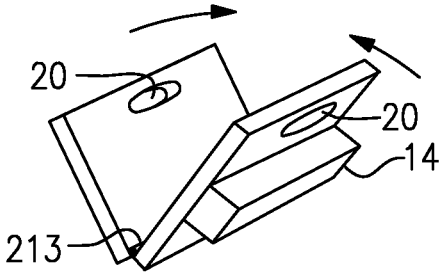

In another possible variation as shown in FIG. 7, the exercise aid 210 may have a base board 212 that is cut through at its mid line with the two portions of the board being held together by a hinge 213 shown here at the mid line. In this case, the base board has hand hold holes 20 at each end. The board may be folded up for storage or for carrying as shown in FIG. 8, and when folded the two hand hold holes 20 align. Here, one side folds under the other. The exercise aid 210 is inverted to fold it up, i.e., with the block 14 below and the bottom side or floor side of the base board 212 upward. In variations, the board 212 may be hinged at two or more places, or may be hinged to fold along a longitudinal cut. Any of various restraints may be used to keep the board 212 unfolded at the hinge(s), including magnets, pins, Velcro or straps, for example.

Still other variations are possible. In a one-side version, the block or beam may be placed at one end of the base board. In that case, the base board may be fastened to the floor surface to preclude rotation of the unit. In another version, the block or beam may be positioned equidistant from the two ends of the base board. The slip resistant coating placed on the underside of the base board can protect the flooring beneath the exercise aid 210.

Height adjustment may be achieved by adding to or taking away material from the block or beam, or by placing an additional thickness of material beneath the base board. Thicknesses of material to add height to the beam or block may have dowels and corresponding sockets for locating and holding these additional thicknesses properly.

In addition to the height adjustment techniques discussed above, the stretch height may also be reduced by adding another fitted base board portion on top of the base board on the long side, when the user is to stand on that side.

Also, in some possible embodiments the beam or block 14 can be supported on the base board 12 using a ladder system with hollow metal legs affixed to the underside of the beam 14 and mating hollow metal legs attached to the base board. These legs would be provided with pin holes such that the height of the top surface of the beam or block can be adjusted to the desired height and maintained there by inserting pins into the hollow metal legs. Many other mechanisms could be employed to allow the height of the top surface of the beam or block to be adjusted relative to the base board so as to be at the proper exercise height for the individual.

The width and/or length of the base board (and beam) can be narrower or wider, shorter or longer, than in the above described embodiments. A narrower exercise aid may be used for exercise of a single foot at a time. A wider exercise aid may be needed for larger persons.

In some possible embodiments, a vibrator may be added either to the base board or to the beam or block, or both. The exercise aid may be of other shapes, of any color, or of a multitude of materials or material combinations.

In some versions, the edges of the beam or block may be chamfered or rounded, or the entire upper surface of the beam or block may be domed or rounded, so as to provide opportunity for alternative therapeutic exercises of the foot.

While the invention has been described and illustrated in respect to selected preferred embodiments, and a few alternative arrangements, it should be appreciated that the invention is not limited only to those embodiments. Rather, many modifications and variations would present themselves to those of skill in the art without departing from the scope and spirit of this invention, as defined in the appended claims.

I claim:

1. A plantar exercise device for a person to use for therapeutic foot exercises, comprising a generally planar rigid base board having first and second ends spaced in a longitudinal direction from one another and having a center midway between the first and second ends, a top surface and an underside spaced apart by a predetermined thickness, the underside being adapted to rest upon a floor surface; and a rigid block member supported upon and secured onto said base board and having a length direction extending across said base board transversely to said longitudinal direction of said base board, said block member having an upper planar surface that is spaced a predetermined height above the top surface of said base board, said block member being positioned between said center of the base board and the second end thereof with the base board projecting a first distance from said block member to said first end, and projecting a second distance, smaller than said first distance, from said block member to said second end, and so as to define a first exercise position between the first end of the baseboard and the block member of sufficient length such that the user places his foot with the heel on the top surface of the base board and his toes on the upper planar surface of the block member, and to define a second exercise position extending from said block member in the direction of said second end and of small enough length such that the user places his foot with the heel on said floor surface beyond said second end and his toes on the upper planar surface of the block member.

2. The plantar exercise device of claim 1 comprising a non-slip treatment applied onto the top surface of said base board and onto the upper planar surface of said block member.

3. The plantar exercise device of claim 1 wherein block member comprises a plurality of thicknesses and is configured so that such thicknesses can be added or removed to modify the height of the upper planar surface above the base board.

4. The plantar exercise device of claim 1 wherein said block member is a solid block member of rigid material and having a nominal thickness of four inches, defining said predetermined height as a nominal four inches.

5. The plantar exercise device of claim 1 wherein said block member is a rigid tubular member having a solid top member defining said upper planar surface, and a hollow core.

6. The plantar exercise device of claim 5 wherein said hollow core is filled with a synthetic foam.

7. The plantar exercise device of claim 1 wherein a handle cut-out is formed in said base board between said block member and one of said first and second ends.

8. The plantar exercise device of claim 1 further comprising one or more additional rigid block members affixed at one or both ends of said block member and each extending partway from the respective end of said block member to create an additional surface for the user to place his toes for performing a therapeutic foot exercise.

9. The plantar exercise device of claim 1 wherein said baseboard is cut through at a line between the first and second ends, and is hinged along said line so that the rigid base board is configured to be folded up when not in use.

10. The plantar exercise device of claim 9 wherein said line is a midline that is disposed substantially midway between said first and second ends.

11. The plantar exercise device of claim 1 wherein said predetermined thickness of the base board is a nominal one inch.

12. The plantar exercise device of claim 1 further comprising a non-slip treatment applied onto the underside of the base board.

* * * * *